US005325789A

United States Patent [19]

Tapias

[11] Patent Number: 5,325,789

[45] Date of Patent: Jul. 5, 1994

[54] TRACK SWITCH FOR MONORAILS HAVING VERTICALLY MOVABLE SWITCH SEGMENTS

[76] Inventor: Oscar C. Tapias, 80-10 258th St., Floral Park, N.Y. 11004

[21] Appl. No.: 58,863

[22] Filed: May 6, 1993

[51] Int. Cl.[5] ..... E01B 25/12

[52] U.S. Cl. ..... 104/130; 246/433

[58] Field of Search ..... 104/131, 130; 246/433

[56] References Cited

U.S. PATENT DOCUMENTS

| | | | |
|---|---|---|---|
| 1,252,662 | 1/1918 | Cobb | 246/433 X |
| 1,273,984 | 7/1918 | Alonzo | 242/433 |
| 3,113,529 | 12/1963 | Maestrelli | 104/130 X |
| 3,841,225 | 10/1974 | Johnson | 104/130 |
| 4,215,837 | 8/1980 | Uozumi et al. | 104/130 X |
| 4,970,965 | 11/1990 | Burg et al. | 104/130 |

*Primary Examiner*—Robert J. Oberleitner
*Assistant Examiner*—S. Joseph Morano
*Attorney, Agent, or Firm*—Collard & Roe

[57] ABSTRACT

A track switch for a train for selectively coupling a main track to a selected one of first and second tracks. The track switch includes a first channel and first support means movable within the first channel between a raised position wherein the first support forms a first track connection between the main track and the first track, and a lowered position wherein the first channel forms a first gap between the main track and the first track. The track switch further includes a second channel and a second support movable within the second channel between a lowered position, wherein the second channel forms a second gap between the main track and the second track, and a raised position, wherein the second channel forms a second track connection between the main track and the second track. A central control unit moves one of the first and second supports to the raised position, and the other of the first and second supports to the lowered position so that a continuous section of track is formed through the track switch for passage of the train.

18 Claims, 4 Drawing Sheets

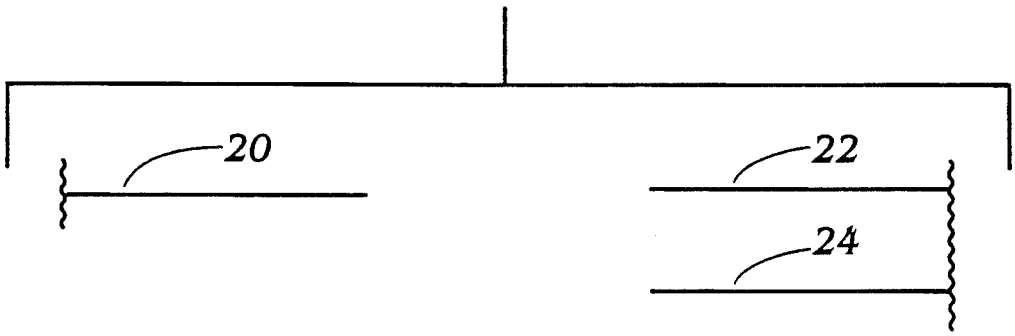
Fig. 1A - Prior Art
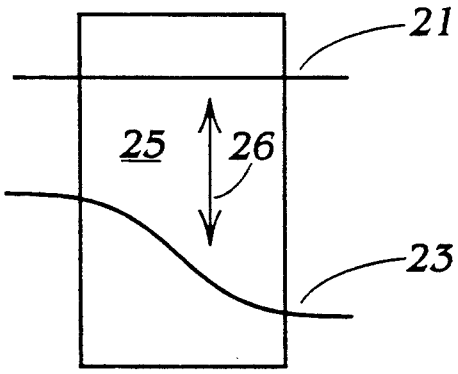
Fig. 1B - Prior Art

TRACK SWITCH FOR MONORAILS HAVING VERTICALLY MOVABLE SWITCH SEGMENTS

CROSS-REFERENCE TO RELATED DOCUMENTS

A Disclosure Document has been filed in the U.S. Patent and Trademark Office relating to this invention on Jan. 25, 1993, and was given Document No. 324,357.

BACKGROUND OF THE INVENTION

1. Field of the Invention

The invention relates to a track switch for a train. More particularly, it relates to a track switch for switching a train between two separate tracks.

2. The Prior Art

Monorails or guideway trains are known which circulate on a single elevated track. These tracks contain Y-shaped branches where a train travelling along the base of the Y must be directed to one of two branches of the Y. Conventional track-switching mechanisms include two track segments, one for connecting the base of the Y to one of the branches, and the other for connecting the base of the Y to the other of the branches. Both track segments are mounted on a sled which slides along rails disposed transverse to the train tracks. The sled moves one of the track segments into place to direct the train from the base to one of the branches.

As can be appreciated, this type of switching mechanism requires the duplication of track segments and requires substantial permanent support scaffolding and propulsion means to support and move the sled. It would be advantageous to have a track switch in which track segments are not duplicated and which does not require permanent support scaffolding. In addition, it would be advantageous to have a track switch which does not extend transversely beyond the width of the individual tracks.

SUMMARY OF THE INVENTION

It is therefore an object of the present invention to overcome the drawbacks of the prior art and to provide a track switch which efficiently and effectively switches a train between tracks.

It is a further object of the present invention to provide a track switch that utilizes a single length of track and avoids duplication of track segments.

It is a further object of the present invention to provide a track switch that does not extend beyond the width of the individual tracks.

It is still another object of the present invention to provide a track switch where a segment of the branch track not being used drops vertically below the main path of travel to provide clearance for the train to pass.

It is yet a further object of the present invention to provide a switch where the segment of the unused track has a width slightly wider than the train aprons.

These and other related objects are achieved according to the invention by a track switch for a train for selectively coupling the main track to a selected one of first and second tracks. The track switch includes first channel means and first support means movable within the first channel means between a raised position wherein the first support means forms a first track connection between the main track and the first track and a lowered position wherein the first channel means forms a first gap between the main track and the first track. The track switch further includes second channel means and second support means movable within the second channel means between a lowered position wherein the second channel means forms a second gap between the main track and the second track and a raised position wherein the second support means forms a second track connection between the main track and the second track. The track switch further includes control means for moving one of the first and second support means to the raised position and the other of the first and second support means to the lowered position, so that a continuous section of track is formed through said track switch for passage of the train.

The control means includes a linear actuator coupled to each of the first and second support means. The control means further includes synchronizing means for synchronously raising one of the first and second support means and lowering the other of said first and second support means.

The track switch also includes a turntable coupled to the main track and pivotable between a first position wherein the turntable is aligned with the first support means in the raised position, and a second position wherein the turntable is aligned with the second support means in the raised position. The synchronizing means pivots the turntable so that it is aligned with the raised one of the first and second support means.

The first channel means cuts obliquely across the first track and the second channel means cuts obliquely across the second track. The first channel means is adjacent to at least part of the second track connection and the second channel means is adjacent to at least part of the first track connection.

In an alternate embodiment of the invention, there is provided a track switch for selectively switching a train from a main track onto a secondary track where each of the main and secondary tracks are substantially T-shaped with a base having two sides and arms having an upper and lower surface. The train has main wheels abutting the upper surface of the arms, up-thrust wheels abutting the lower surface of the arms, guide wheels guided by the two sides of the base and a bogie having all of the wheels rotatably mounted thereon.

The track switch includes a turntable operatively coupled to a section of the main track and pivotable between a first position and a second position. The track switch includes a first channel and a first bridge forming a section of the main track. The first bridge is movable within the first channel between the raised position wherein the first bridge is aligned with a turntable in the first position for passage of the train along the main track and a lowered position wherein the first channel forms a first gap in the main track. The track switch further includes a second channel and a second bridge forming a section of the secondary track. The second bridge is movable within the second channel between a raised position wherein the second bridge is aligned with the turntable in the second position for passage of the train from the main track to the secondary track, and a lowered position wherein the second channel forms a second gap between the main track and the secondary track.

The track switch also has first locking means for locking the first bridge in the raised position to the main track and second locking means for locking the second bridge in the second position to the main track and the secondary track. The track switch further includes synchronizing means for synchronously moving one of the bridges to the raised position and simultaneously moving the other of the bridges to the lowered position, locking the raised bridge in position with the corresponding locking means and pivoting the turntable to one of its positions corresponding to the raised bridge. In this manner, a continuous section of track is formed through the track switch for passage of the train.

BRIEF DESCRIPTION OF THE DRAWINGS

Other objects and features of the present invention will become apparent from the following detailed description considered in connection with the accompanying drawings which discloses an embodiment of the present invention. It should be understood, however, that the drawings are designed for the purpose of illustration only and not as a definition of the limits of the invention.

In the drawings, wherein similar reference characters denote similar elements throughout the several views:

FIGS. 1A and 1B are a schematic diagram of the prior art track switching apparatus;

DETAILED DESCRIPTION OF THE PREFERRED EMBODIMENT

Figure 2A:
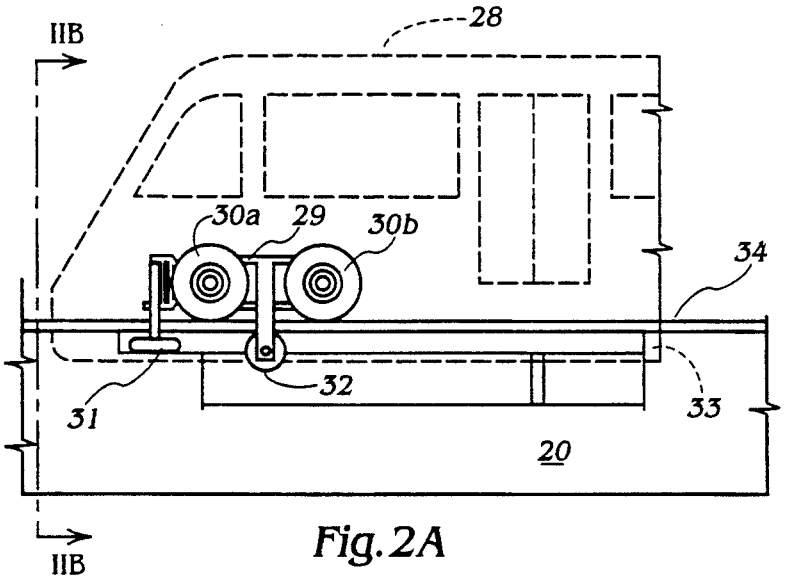
FIG. 2A is a side-elevational view of an embodiment of a track switch according to the invention showing the train in phantom line.

Referring now to the drawings and, in particular, FIGS. 1A and 1B, there is shown a prior art track switching configuration including a main track 20, a first track 22, and a second track 24. Trains travelling along track 20 will pass through a track switch and be selectively directed either onto first track 22 or second track 24. The prior art switching device consists of a first track connection 21 and a second track connection 23 both mounted on a sled 25. Sled 25 is movable in direction 26 transverse to the longitudinally-extending tracks. In order to couple main track 20 to first track 22, sled 25 is slid along transverse rails until first track connection 21 is aligned with tracks 20 and 22. In order to couple main track 20 to second track 24, sled 25 is again moved in order to align second track connection 23 with main track 20 and second track 24.

As can be appreciated, the prior art switch requires a duplication of track sections, namely, first track connection 21 and second track connection 23. In addition, the prior art switch requires substantial permanent support scaffolding off to either side of tracks 20, 22 and 24. In addition, the prior art switch requires transverse rails in order to guide the movements of sled 25 and necessary sled propulsion means. A major disadvantage of the prior art switch is that substantial space is needed transverse to the longitudinal direction of tracks 20, 22 and 24. Therefore, the prior art switches can only be located where sufficient space exists off to either side of the tracks.

Figure 2B:
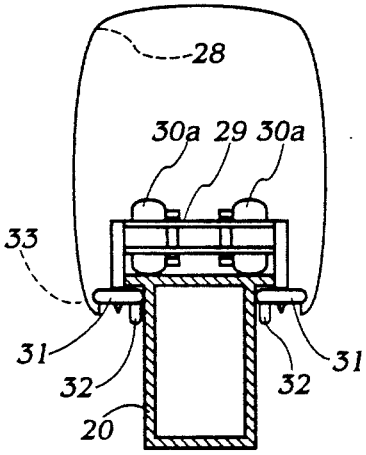
FIG. 2B is a front side-elevational view taken along the line IIB—IIB from FIG. 2A.

Referring now to FIGS. 2A and 2B, there is shown a train 28 riding on main track 20. Each end of train 28 includes a bogie 29 and main wheels 30, guide wheels 31 and up-thrust wheels 32. Main wheels 30 support the weight of train 28 on a top surface 34 of main track 20. Up-thrust wheels 32 keeps train 28 from tipping in high winds or around steep curves. Guide wheels 31 keeps train 28 centered on track 34 and assists in guiding the train around curves. Bogies 29 are mounted at either end of the car and are fixed with respect to train 28. Front wheels **30*a*, however, can be pivoted around a vertical axis. In this manner, guide wheels 31 can pivot front wheels 30*a* in order to steer train 28 around curves. An apron 33 extends down over the sides of bogie 29 to protect and conceal bogie 29 and wheels 30, 31, 32 and eventual power pick-up shoes. Only the front wheels 30*a* of each bogie 29** turn about independent vertical axes in such a way as to have both their horizontal axes converging to a single point, which is the center of curvature of the track. The track's center of curvature may be different for the front bogie and for the rear bogie.

Figure 3:
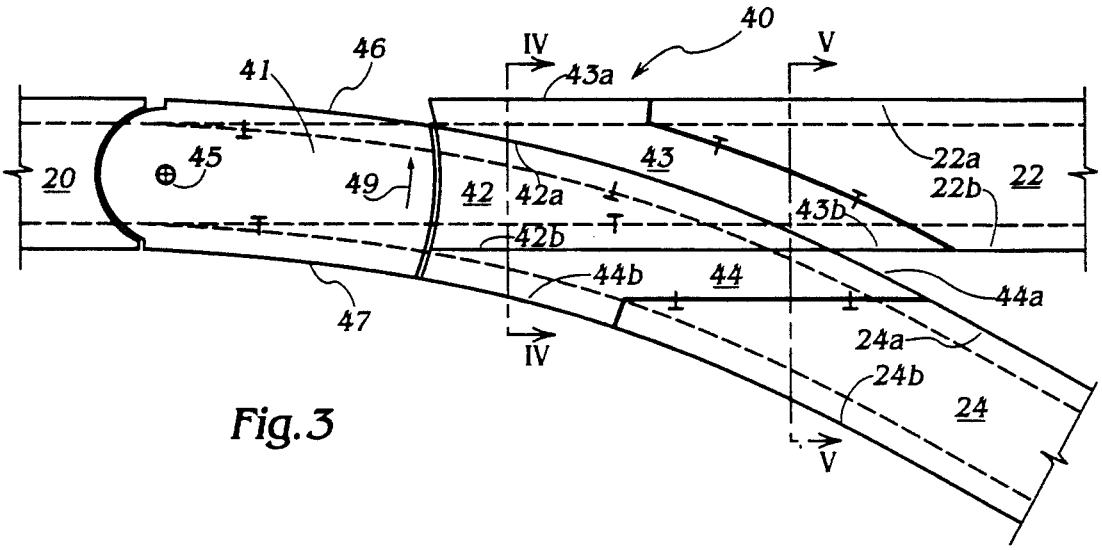
FIG. 3 is a top plan view of an embodiment of the track switch.

As can be seen in FIG. 3, there is a track switch 40, according to the invention, for selectively coupling main track 20 to either first track 22 or second track 24. The space between main track 20 and first track 22 is occupied by a turntable 41, a stationary island 42, and a first support member 43. The space between main track 20 and second track 24 is also occupied by turntable 41 and island 42. A second support member 44 is located between island 42 and second track 24. Turntable 41 is pivotable about an axis 45. In the position shown, a first edge 46 is aligned with an edge **42*a* of island 42, an edge 44*a* of second support member 44 and an edge 24*a* of second track 24. Second edge 47 is aligned with an edge 44*b* of second support member 44 and an edge 24*b* of second track 24. In this configuration, a continuous section of track is formed between main track 20 and second track 24. Train 28 can pass from main track 20 to second track 24 as long as first support member 43 is lowered so as to not interfere with up-thrust wheels 32 or apron 33**.

Alternatively, turntable 41 can be pivoted slightly in direction 49 so that first edge 46 is aligned with an edge **43*a* of first support member 43 and an edge 22*a* of first track 22. Second edge 47 would then be aligned with a lower edge 42*b* of island 42, a lower edge 43*b* of first support member 43 and a lower edge 22*b* of first track 22. In this configuration, train 28 could pass from main track 20 to first track 22 as long as second support member 44 was lowered so as to not interfere with up-thrust wheels 32 or apron 33**.

Figure 4:
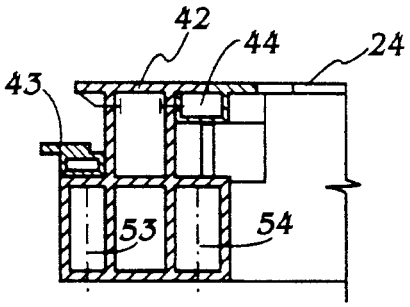
FIG. 4 is a cross-sectional view taken along the line IV—IV from FIG. 3.
Figure 5:
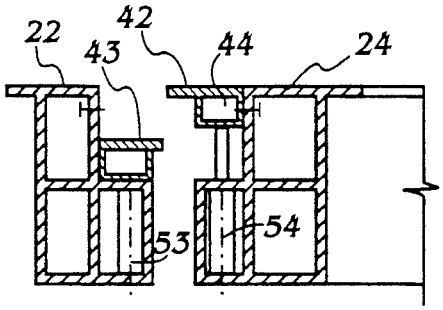
FIG. 5 is a cross-sectional view taken along the line V—V from FIG. 3.

FIGS. 4 and 5 show two sections through switch 40 with island 42 substantially in the middle of each view. FIG. 4 shows first support member 43 in the lowered position and second support member 44 in the raised position. Island 42 and second support member 44 cooperatively form a complete track section between turntable 41 and second track 24. FIG. 5 also shows first support member 43 in the lowered position and second support member 44 in the raised position. In the view of FIG. 5, island 42, second support member 44, and second track 24 cooperatively form a section of track to support train 28. Beneath support members 43 and 44 there is shown first actuator means 53 and second actuator means 54 for raising and lowering support members 43 and 44, respectively.

Figure 6:
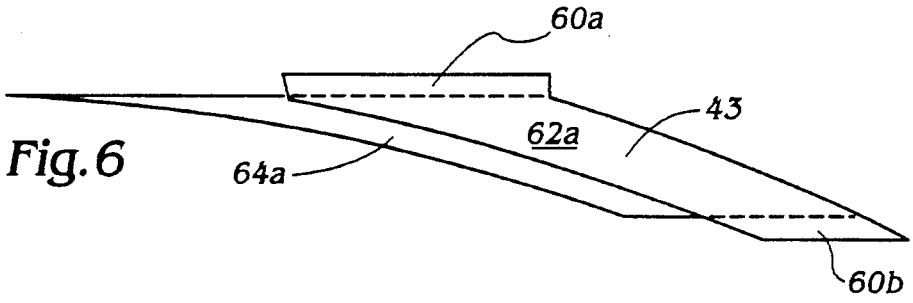
FIG. 6 is a top plan view of an embodiment of a first support member.
Figure 7:
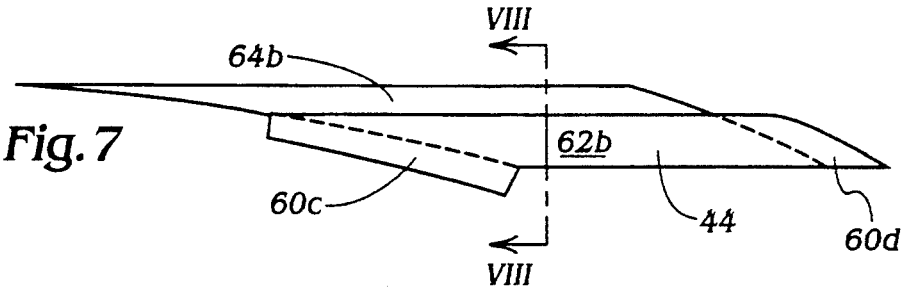
FIG. 7 is a top plan view of an embodiment of a second support member.
Figure 8:
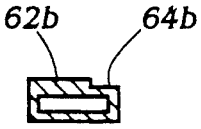
FIG. 8 is a cross-sectional view taken along the line VIII—VIII from FIG. 7.

FIGS. 6 and 7 show that support members 43 and 44 each have three main parts, cantilevered regions 60*a*, 60*b*, 60*c* and 60*d*, main regions 62*a* and 62*b*, and retracted or depressed regions 64*a* and 64*b*. Cantilevered regions 60 form the arms of the T-shaped track and provide a surface against which up-thrust wheels 32 abut. Main regions 62 are located above the base of the T-shaped track and depressed regions 64 overlap with the cantilevered regions of island 42. FIG. 8 shows main region 62*b* and depressed region 64.

Figure 9:
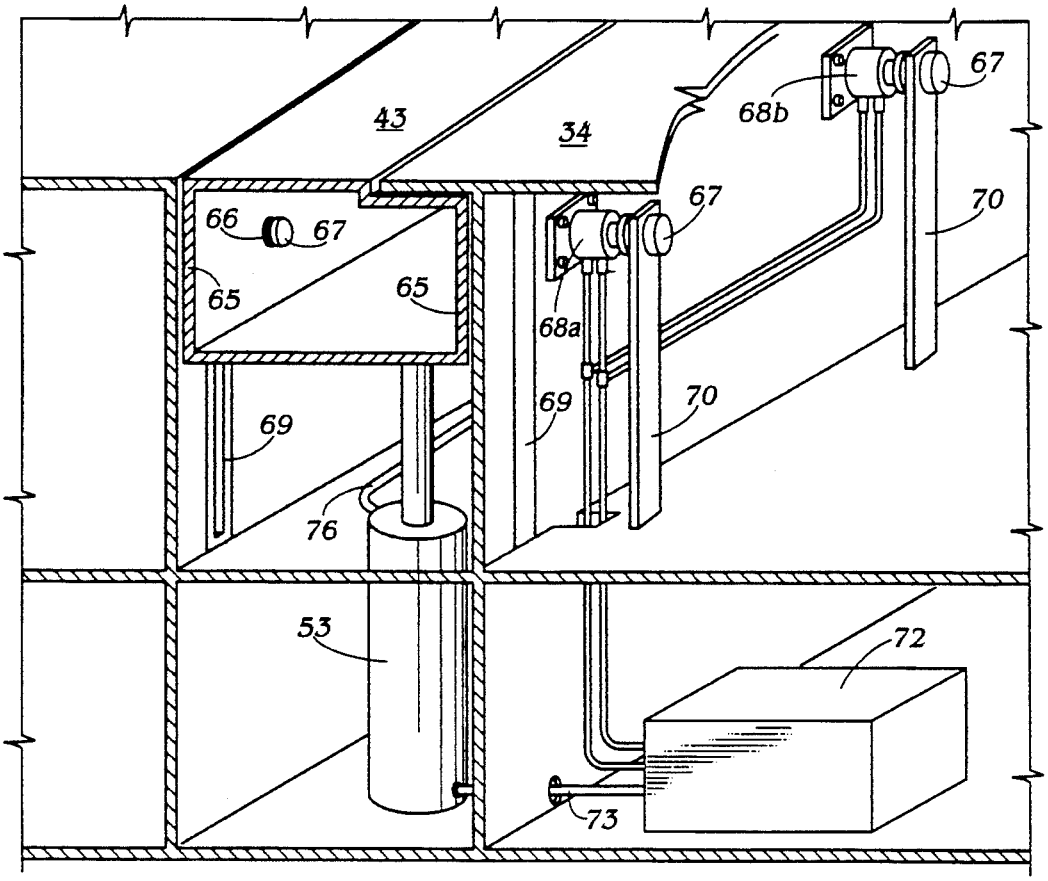
FIG. 9 is a perspective view showing an embodiment of the linear actuators and locks according to the invention.

FIG. 9 shows first support member 43 and first actuator 53 which is a hydraulic piston, for example. First support member 43 has side panels 65 with apertures 66 that align with lock bars 67 when support member 43 is in the raised position. Lock bars 67 are inserted and retracted by lock bar actuators 68, which are hydraulically-operated actuators, for example. Side panels 65 also include guide arms that travel along guide channel 69 disposed within tracks 22, 24 and island 42.

Each lock bar 67 is coupled to the top end of a strap 70. The lower ends of straps 70 are secured to the floor. Straps 70 provide two important functions with respect to lock bars 67. First, when lock bars 67 are inserted into apertures 66 of first support member 43, their purpose is to maintain first support member 43 in its fully raised position aligned with top surface 34. The weight of train 28 on top of first support member 43 forces first support member 43 downward. Straps 70 prevent lock bars 67 from pivoting under the downward force exerted on first support member 43. Second, when lock bars 67 are retracted from apertures 66, lock bar actuators 68 bend straps 70 away from first support member 43 against the restoring force of straps 70. Since straps 70 are biasing lock bars 67 into their inserted positions, this operates as a safety feature in the event of loss of hydraulic pressure or power failure. Once lock bars 67 are inserted, a positive force is required in order to retract lock bars 67.

Figure 10:
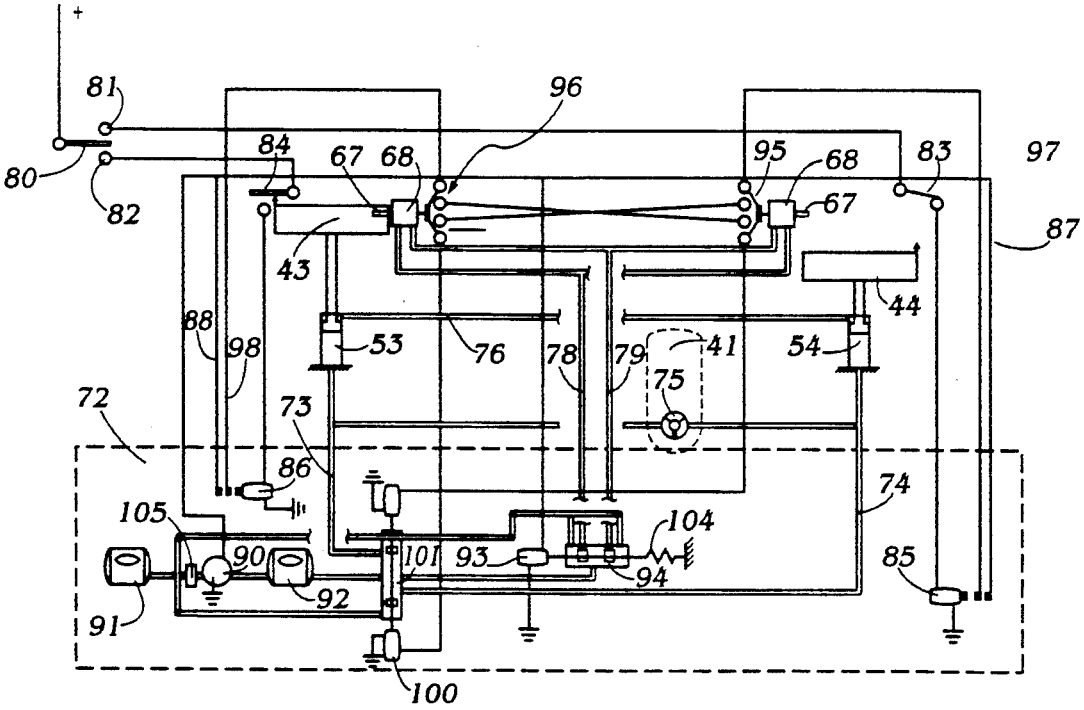
FIG. 10 is a schematic diagram showing an embodiment of the electrical and hydraulic systems according to the invention.

The hydraulic actuators 53 and 68 are controlled by a central control unit 72. Control unit 72 includes the oil accumulators, oil pump, spool valves, relay switches and check valve, for rapid replacement in case of malfunction. As can be seen in FIG. 10, central control unit 72 includes first hydraulic lines 73 for raising first support member 43 and rotating turntable 41 toward first support member 43. Turntable 41 is rotated by rotational actuator 75. A second hydraulic line 74 is used to raise second support member 44 into its raised position and rotate turntable 41 toward second support member 44. A connecting line 76 is provided between actuators 53 and 54. Connecting lines 76 coordinates the relative movement between support members 43 and 44.

In order to raise first support member 43, central control unit 72 pumps hydraulic fluid through first hydraulic lines 73 to operate first actuator 53. The accumulated fluid above the hydraulic piston is then forced through connecting lines 76 into the upper chamber of second actuator 54. This forces second support member 44 into its lowered position with the fluid in the lower chamber of second actuator 54 being discharged through second hydraulic line 74 which operates as a relief line. In order to raise second support member 44 and lower first support member 43, second hydraulic line 74 is pressurized and first hydraulic line 73 acts as a relief line.

Central control unit 72 is also coupled to a third hydraulic line 78 for retracting lock bars 67 and a fourth hydraulic line 79 for moving lock bars 67 into the locked position. While hydraulic line 78 or 79 is pressurized, the other line operates as a relief line. Central control unit 72 coordinates pressurization of the hydraulic lines as follows. Hydraulic line 78 is pressurized to release lock bars 67 and then either hydraulic line 73 or 74 is pressurized to raise the lowered support member. At the same time, turntable 41 is rotated to be aligned with the raised support member. Once the support member to be raised has reached its uppermost position, hydraulic line 79 is pressurized to insert lock bars 67 and lock the raised support member in place.

A master switch 80 is a two-position switch for selectively energizing first contact 81 or second contact 82. First contact 81 is utilized to raise second support member 44 while second contact 82 is used to raise first support member 43. Since first support member 43 is already in the raised position, connecting master switch 80 to second contact 82 would have no effect as a second sensor 84 senses that first support member 43 is already in the raised position and an open circuit condition exists. However, the corresponding first sensor 83 is closed since second support member 44 is in the lowered position. Therefore, movement of master switch 80 into contact with first contact 81 energizes first relay 85.

Relay 85 first energizes a first pump line 87 which activates pump 90 to pump oil from low pressure accumulator 91 into high pressure accumulator 92 through check valve 105. Check valve 105 is located between high and low pressure accumulators 92, 91 to prevent pressure equalization when the power is turned off. First pump line 87 also energizes solenoid 93 pulling spool valve 94 to the left permitting pressurized oil to flow into third hydraulic line 78 to release lock bars 67. Release sensors 95 and 96 are coupled in series to lock bars 67. Each support member has a plurality of lock bars, each equipped with a release sensor. When all lock bars 67 have been retracted, release sensors 95 couple energized line 97 to solenoid 100 pulling spool valve 101 downward allowing high pressure oil to flow into first hydraulic line 74. Second support member 44 is raised while first support member 43 is lowered.

In addition, turntable 41 is rotated toward second support member 44. When second support member 44 reaches its uppermost position, sensor 83 creates an open circuit and all of the electrical systems are deactivated. Spool valve 94 is retracted by spring 104 now that solenoid 93 is no longer energized. This also allows oil to flow from high pressure accumulator 92 through hydraulic line 79 to forcible drive lock bars 67 into their locked position. Fluid returns along hydraulic line 78 into low pressure accumulator 91.

In order to return first support member 43 to its raised position, master switch 80 is coupled to second contact 82 to energize relay 86. As can be appreciated, connecting master switch 80 to contact 81 would have no effect as sensor 83 has creating an open circuit condition, due to the raised position of second support member 44. Pump 90 is activated and lock bars 67 are retracted. First support member 43 is raised, second support member 44 is lowered, turntable 41 is pivoted toward first support member 43, and lock bars 67 are moved into their locked position once first support member 43 has reached its fully raised position, as detected by sensor 84.

Although the invention has been described with reference to a T-shaped hollow track, the advantages disclosed by the invention are equally applicable to tracks having different configurations and being either hollow or solid. Similarly, different track configurations may utilize different train configurations, all of which are contemplated by the invention. The support members 43 and 44 may be designed in a variety of alternate configurations. FIG. 3 shows a straight track with a second track curving away from the straight track. The invention is equally applicable to a Y-shaped switch wherein both arms of the Y curve away from the base of the Y.

Furthermore, support members 43 and 44, as shown, provide the minimum clearance in their lowered position for the passage of the train to the other track. It should be understood, however, that support members 43 and 44 may have a variety of alternate configurations, depending on the particular application and structural limitations. For example, support members 43 and 44 could each include a larger portion of track 22 or 24, whereas instead of cutting obliquely across the tracks, they could cut perpendicularly across tracks 22 or 24. It is also possible that island 42 could be part of turntable 41, such that the entire triangular unit pivots when switching. As can be appreciated, there are a large number of alternate configurations including turntable 41, island 42 and support members 43 and 44.

While only a single embodiment of the present invention has been shown and described, it is to be understood that many changes and modifications may be made thereunto without departing from the spirit and scope of the invention as defined in the appended claims.

What is claimed is:

1. A track switch for a train for selectively coupling a main track to a selected one of first and second tracks, said track switch comprising:

first channel means;

first support means movable within said first channel means between a raised position wherein said first support means forms a first track connection between said main track and said first track and a lowered position wherein the first channel means forms a first gap between said main track across the entire cross-section thereof and said first track;

second channel means;

second support means movable within said second channel means between a lowered position wherein the second channel means forms a second gap between the main track across the entire cross-section thereof and said second track and a raised position wherein said second channel means forms a second track connection between the main track and said second track; and control means for moving one of said first and second support means to said raised position and the other of said first and second support means to said lowered position, so that a continuous section of track is formed through said track switch for passage of the train.

2. A track switch for a train as claimed in claim 1, wherein said control means comprises:

a linear actuator coupled to each of said first and second support means; and synchronizing means for synchronously raising one of said first and second support means and lowering the other of said first and second support means.

3. A track switch for a train, as claimed in claim 2, further comprising:

locking means for locking said first support means in said raised position to said main track and said first track and for locking said second support means in said raised position to said main track and said second track.

4. A track switch for a train, as claimed in claim 3, wherein said main track, said first track and said first support means include a first set of lock-receiving means which are aligned when said first support means is in said raised position and said main track, said second track and said second support means include a second set of lock-receiving means which are aligned when said second support means is in said raised position.

5. A track switch for selectively switching a train from a main track onto a secondary track, each of said main and secondary tracks being substantially T-shaped with a base having two sides and arms having an upper and lower surface, said train having main wheels abutting the upper surface of said arms, up-thrust wheels abutting the lower surface of said arms, guide wheels guided by said two sides of said base and a bogie having all of said wheels mounted thereon, said track switch comprising:

a turntable operatively coupled to a section of the main track and pivotable between a first position and a second position;

a first channel;

a first bridge forming a section of said main track, said first bridge being movable within said first channel between a raised position wherein said first bridge is aligned with said turntable in said first position for passage of the train along said main track and a lowered position wherein said first channel forms a first gap in said main track;

a second channel;

a second bridge forming a section of said secondary track, said second bridge being movable within said second channel between a raised position wherein said second bridge is aligned with said turntable in said second position for passage of said train from said main track to said secondary track and a lowered position wherein said second channel forms a second gap between said main track and said secondary track;

first locking means for locking said first bridge, in said raised position, to said main track;

second locking means for locking said second bridge, in said raised position, to said main track and said secondary track; and synchronizing means for synchronously:

(i) moving one of said bridges to said raised position and simultaneously moving the other of said bridges to said lowered position;

(ii) locking said raised bridge in position with a corresponding locking means; and (iii) pivoting said turntable to one of its positions corresponding to said raised bridge, so that a continuous section of track is formed through said track switch for passage of the train.

6. A track switch for a train, as claimed in claim 5, wherein said first channel has a generally U-shaped configuration having two spaced sides and a base disposed between said spaced sides, and said second channel has a generally U-shaped configuration with two spaced sides and a base disposed between said spaced sides.

7. A track switch for a train, as claimed in claim 6, wherein said spaced sides of said first channel are defined by said main track.

8. A track switch for a train, as claimed in claim 7, wherein one of said sides of said second channel is defined by said main track and the other of said sides of said second channel is defined by said secondary track.

9. A track switch for a train, as claimed in claim 8, wherein said main track and said first bridge include a first set of lock-receiving means which are aligned when said first bridge is in said raised position and said main track, said secondary track and said second bridge include a second set of lock-receiving means which are aligned when said second bridge is in said raised position.

10. A track switch for a train, as claimed in claim 9, wherein said first locking means comprises a first set of locking bars and said second locking means comprises a second set of locking bars.

11. A track switch for a train, as claimed in claim 10, wherein said synchronizing means locks said raised bridge in position by engaging a corresponding set of locking bars with a corresponding lock-receiving means.

12. A track switch for a train, as claimed in claim 11, wherein at least a portion of said first and second bridges is configured to receive a section of the main track in an overlapping relationship.

13. A track switch for a train, as claimed in claim 12, wherein the remaining portions of said first and second bridges has the same elevation as said main track in the raised position.

14. A track switch for a train, as claimed in claim 13, wherein said first and second channel means have a width slightly wider than a width of the train bogie and said wheels so that clearance is provided for the train when a corresponding bridge is in said lowered position.

15. A track switch for a train for selectively coupling a main track to a selected one of first and second tracks, said track switch comprising:

first channel means;

first support means movable within said first channel means between a raised position wherein said first support means forms a first track connection between said main track and said first track and a lowered position wherein the first channel means forms a first gap between said main track and said first track;

second channel means;

second support means movable within said second channel means between a lowered position wherein the second channel means forms a second gap between the main track and said second track and a raised position wherein said second channel means forms a second track connection between the main track and said second track;

control means including (i) a linear actuator coupled to each of said first and second support means; and (ii) synchronizing means for synchronously raising one of said first and second support means and lowering the other of said first and second support means;

wherein said control means moving one of said first and second support means to said raised position and the other of said first and second support means to said lowered position, so that a continuous section of track is formed through said track switch for passage of the train;

locking means for locking said first support means in said raised position to said main track and said first track and for locking said second support means in said raised position to said main track and said second track;

wherein said main track, said first track and said first support means including a first set of lock-receiving means which are aligned when said first support means is in said raised position; and said main track, said second track and said second support means including a second set of lock-receiving means which are aligned when said second support means is in said raised position; and a turntable coupled to said main track and pivotable between a first position, wherein said turntable is aligned with said first support means in said raised position, and a second position wherein said turntable is aligned with said second support means in said raised position.

16. A track switch for a train as claimed in claim 15, wherein said synchronizing means pivots said turntable so that it is aligned with the raised one of said first and second support means.

17. A track switch for a train as claimed in claim 16, wherein said first channel means cuts obliquely across said first track and said second channel means cuts obliquely across said second track.

18. A track switch for a train as claimed in claim 17, wherein said first channel means is adjacent to at least part of said second track connection and said second channel means is adjacent to at least part of said first track connection.

* * * * *